US008049437B2

(12) United States Patent
Chang et al.

(10) Patent No.: US 8,049,437 B2
(45) Date of Patent: Nov. 1, 2011

(54) SYSTEM AND METHOD FOR REAL TIME CONTROL OF LIGHTING SYSTEM

(75) Inventors: Chih-Kuang Chang, Taipei Hsien (TW); Li Jiang, Shenzhen (CN); Dong-Hai Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 976 days.

(21) Appl. No.: 11/967,030

(22) Filed: Dec. 29, 2007

(65) Prior Publication Data

US 2009/0115337 A1 May 7, 2009

(30) Foreign Application Priority Data

Nov. 6, 2007 (CN) ..... 2007 1 0202404

(51) Int. Cl.
*G05F 1/00* (2006.01)

(52) U.S. Cl. ..... 315/297; 315/292; 315/312; 315/318; 315/82; 700/24; 700/73; 700/75; 340/468

(58) Field of Classification Search ..... 315/291, 315/292, 294, 297, 307, 312, 316, 318, 360, 315/DIG. 4, 82; 700/20, 24, 84, 73, 75; 340/468, 340/472

See application file for complete search history.

(56) References Cited

U.S. PATENT DOCUMENTS

| | | | | |
|---|---|---|---|---|
| 3,898,643 | A * | 8/1975 | Ettlinger | 700/84 |
| 4,980,806 | A * | 12/1990 | Taylor et al. | 362/85 |
| 6,728,018 | B2 | 4/2004 | Norimatsu | |
| 7,202,613 | B2 * | 4/2007 | Morgan et al. | 315/312 |
| 7,332,877 | B2 * | 2/2008 | Crodian et al. | 315/297 |
| 7,397,195 | B2 * | 7/2008 | Yu et al. | 315/194 |
| 7,729,941 | B2 * | 6/2010 | Zampini et al. | 705/14.4 |

* cited by examiner

*Primary Examiner* — Haiss Philogene
(74) *Attorney, Agent, or Firm* — Altis Law Group, Inc.

(57) ABSTRACT

A method for real time control of lighting system includes the steps of: providing a computer, a SCM (2), a digital-to-analog converter (3), and at least one power amplifier (41, 42, 43) connected to the digital-to-analog converter, each of the at least one power amplifiers connects with a lamp; receiving light control data inputted by a user; transmitting the light control data to the SCM; processing the light control data received by the SCM, and generating digital signals by the SCM; transmitting the digital signals to the digital-to-analog converter; converting the digital signals into an analog signals by the digital-to-analog converter, and transmitting the analog signals to the at least one power amplifier; and amplifying the analog signals and controlling the corresponding lamp connected to the at least one power amplifier. A system for real time control of the lighting system is also provided.

12 Claims, 2 Drawing Sheets

SYSTEM AND METHOD FOR REAL TIME CONTROL OF LIGHTING SYSTEM

BACKGROUND OF THE INVENTION

1. Field of the Invention

The present invention relates, generally, to systems and methods for real time control of lighting system.

2. Description of Related Art

Currently, lighting control is mostly done by manually operating a controller. The effect of the lighting control may be influenced by the following factors: Stability of brightness, controlling speed, and light interference between lamps. Manual control involves human judgment and reflexes and this results in instability of brightness and slow reactive control of the lamps.

Accordingly, what is needed is a system and method for real time control of lighting system, which can control the brightness of lamps in real time.

SUMMARY OF THE INVENTION

One preferred embodiment provides a system for real time control of lighting system. The system includes a computer, a single chip micyoco (SCM), a digital-to-analog converter, and at least one power amplifier that is connected to the digital-to-analog converter, each of the at least one power amplifiers connects with a lamp. The computer includes a light data receiving module and a light data transmitting module. The SCM includes a processing module and a transmitting module. The light data receiving module is configured for receiving light control data inputted by a user. The light data transmitting module is configured for transmitting the light control data to the SCM. The processing module is configured for processing the light control data received by the SCM, and generating digital signals that represent brightness. The transmitting module is configured for transmitting the digital signals to the digital-to-analog converter. The digital-to-analog converter is configured for converting the digital signals into analog signals, and transmitting the analog signals to the at least one power amplifier. The at least one power amplifier is configured for amplifying the analog signals, and for controlling the brightness of the corresponding lamp connected to the at least one power amplifier.

Another preferred embodiment provides a method for real time control of lighting system. The method includes the steps of: Providing a computer, a single chip micyoco (SCM) connected to the computer, a digital-to-analog converter connected to the SCM, and at least one power amplifier connected to the digital-to-analog converter, each of the at least one power amplifiers connects with a lamp; receiving light control data inputted by a user; transmitting the light control data to the SCM; processing the light control data received by the SCM, and generating digital signals that represent brightness by the SCM; transmitting the digital signals to the digital-to-analog converter; converting the digital signals into an analog signals by the digital-to-analog converter, and transmitting the analog signals to the at least one power amplifier; and amplifying the analog signals and controlling the brightness of the corresponding lamp connected to the at least one power amplifier.

Other systems, methods, features, and advantages will be or become apparent to one skilled in the art upon examination of the following drawings and detailed description.

DETAILED DESCRIPTION OF THE INVENTION

Figure 1:
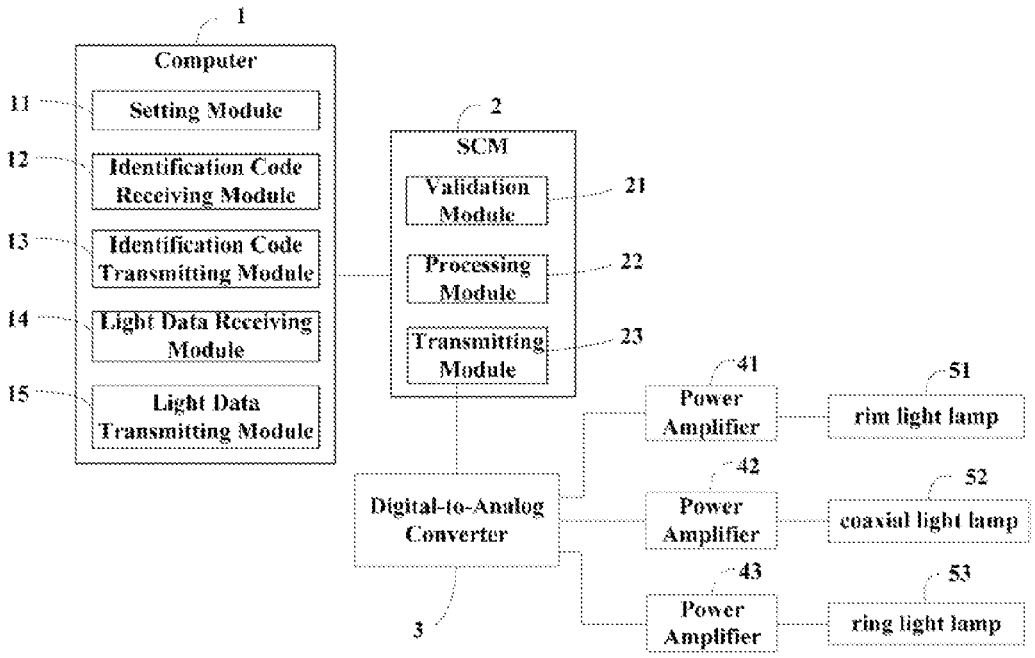
FIG. 1 is a block diagram of a system for real time control of lighting system in accordance with one preferred embodiment.

FIG. 1 is a block diagram of a system for real time control of lighting system in accordance with one preferred embodiment. The system typically includes a computer 1, a single chip micyoco (SCM) 2, a digital-to-analog converter 3, three power amplifiers 41, 42, and 43, a rim light lamp 51, a coaxial light lamp 52, and a ring light lamp 53. The SCM 2 is connected to the computer 1 via a RS232 serial port of the SCM 2. The digital-to-analog converter 3 is connected to the SCM 2 and the power amplifiers 41, 42, and 43. The rim light lamp 51 is connected with the power amplifier 41 to form a first channel. The coaxial light lamp 52 is connected with the power amplifier 42 to form a second channel. The ring light lamp 53 is connected with the power amplifier 43 to form a third channel. The three power amplifiers and the three lamps in the preferred embodiment are only an example, in other embodiments, the quantities of the power amplifiers and the lamps may be controlled according to measurement requirements.

The computer 1 includes a setting module 11, an identification code receiving module 12, an identification code transmitting module 13, a light data receiving module 14, and a light data transmitting module 15. The SCM 2 includes a validation module 21, a processing module 22, and a transmitting module 23.

The setting module 11 is configured for setting the communication parameters of the serial port of the computer 1 and the serial port of the SCM 2. The communication parameters of the serial port include a serial port number, a baud rate, a data bit, a stop bit, and a parity bit.

The identification code receiving module 12 is configured for receiving identification codes inputted by a user through an input device of the computer 1. The identification codes are used for validating the identification of the user and determining whether the user has the authority to control the lamps. The input device may be a keyboard, a mouse, or a scanner.

The identification code transmitting module 13 is configured for transmitting the identification codes to the SCM 2.

The validation module 21 is configured for validating the identification codes by comparing the identification codes received by the SCM 2 with original identification codes prestored in the SCM 2. If the identification codes match the original identification codes, the identification codes are determined to be validated and the user has the ability to control the lamps; if the identification codes do not match the original identification codes, the identification codes are considered invalid and the user will not be able to assume control the lamps.

The light data receiving module 14 is configured for receiving light control data inputted by the user if the identification codes are validated. The light control data includes a light control data of the rim light lamp 51, a light control data of the coaxial light lamp 52 and a light control data of the ring light lamp 53.

The light data transmitting module 15 is configured for transmitting the light control data to the SCM 2.

The processing module 22 is configured for processing the light control data received by the SCM 2, and generating digital signals that represent brightness and an address corresponding to the first channel or the second channel or the third channel according to the light control data.

The transmitting module 23 is configured for transmitting the digital signals and the address to the digital-to-analog converter 3.

The digital-to-analog converter 3 is configured for converting the digital signals into analog signals, and transmitting the analog signals to a corresponding power amplifier 41, 42, or 43 according to the address. For example, if the address corresponds to the first channel, the digital-to-analog converter 3 transmits the analog signals to the power amplifier 41.

The power amplifier 41 is configured for amplifying the analog signals and controlling the brightness of the rim light lamp 51. The power amplifier 42 is configured for amplifying the analog signals and controlling the brightness of the coaxial light lamp 52. The power amplifier 43 is configured for amplifying the analog signals and controlling the brightness of the ring light lamp 53.

Figure 2:
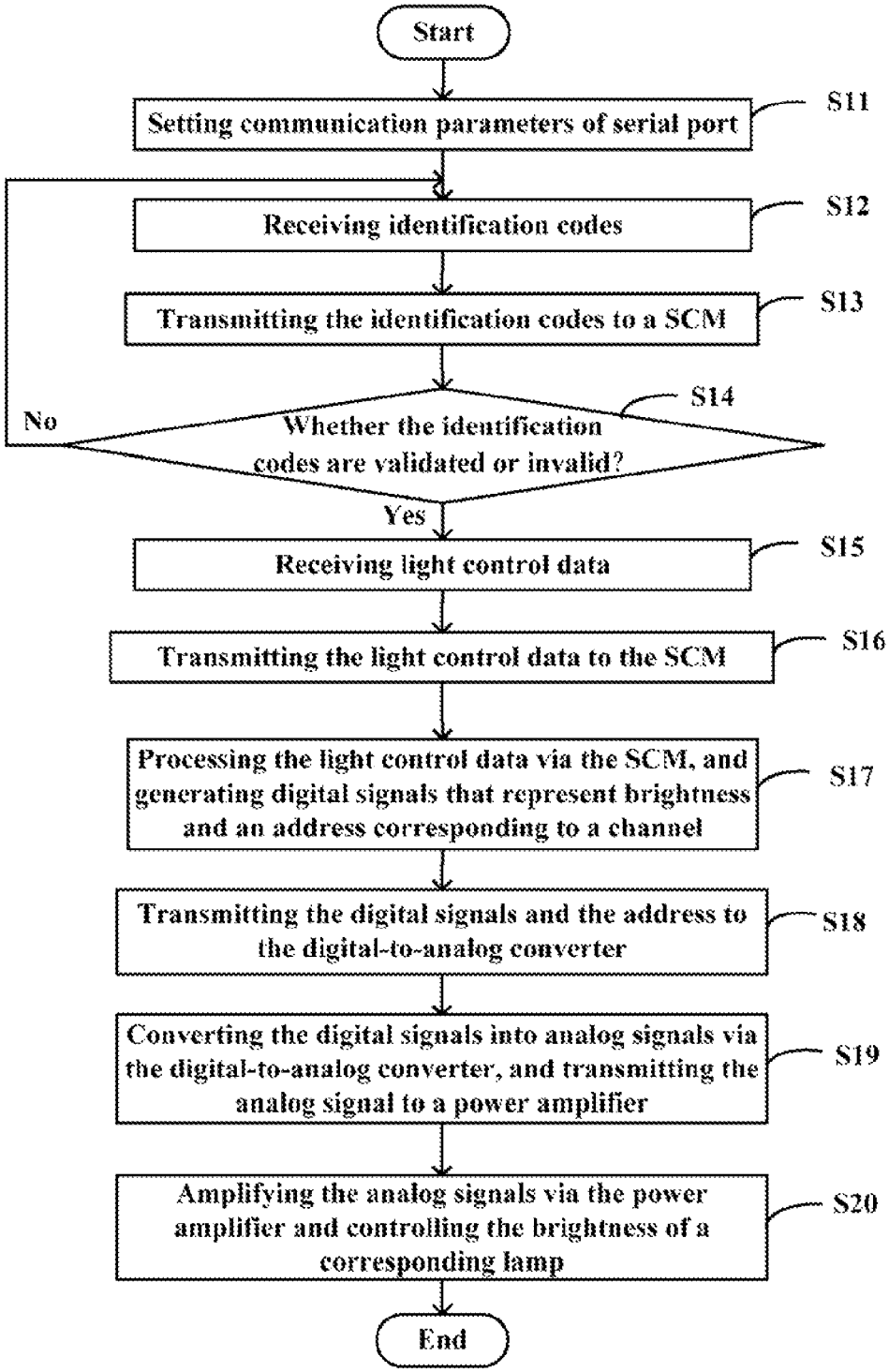
FIG. 2 is a flowchart of a method for real time control of lighting system in accordance with the preferred embodiment.

FIG. 2 is a flowchart of a method for real time control of lighting system in accordance with the preferred embodiment.

In step S11, the setting module 11 sets the communication parameters of the serial port of the computer 1 and the serial port of the SCM 2. The communication parameters of the serial port include the serial port number, the baud rate, the data bit, the stop bit, and the parity bit.

In step S12, the identification code receiving module 12 receives identification codes inputted by the user through the inputting device of the computer 1. The identification codes are used for validating the identification of the user and determining whether the user has the authority to control the lamps.

In step S13, the identification code transmitting module 13 transmits the identification codes to the SCM 2.

In step S14, the validation module 21 validates the identification codes by comparing the identification codes received by the SCM 2 with the original identification codes prestored in the SCM 2. If the identification codes match the original identification codes, the identification codes are determined to be validated and the user has the ability to control the lamps; if the identification codes do not match the original identification codes, the identification codes are considered invalid, and the user will not be able to control the lamps.

In step S15, the light data receiving module 14 receives light control data inputted by the user if the identification codes are validated. The light control data includes a light control data of the rim light lamp 51, a light control data of the coaxial light lamp 52, and a light control data of the ring light lamp 53.

In step S16, the light data transmitting module 15 transmits the light control data to the SCM 2.

In step S17, the processing module 22 processes the light control data received by the SCM 2, and generates the digital signals and the address corresponding to the first channel or the second channel or the third channel according to the light control data.

In step S18, the transmitting module 23 transmits the digital signals and the address to the digital-to-analog converter 3.

In step S19, the digital-to-analog converter 3 converts the digital signals into the analog signals, and transmits the analog signals to a corresponding power amplifier 41, 42, or 43 according to the address.

In step S20, the power amplifier 41, 42 or 43 amplifies the analog signals and controlling the brightness of the corresponding rim light lamp 51, the corresponding coaxial light lamp 52, or the corresponding ring light lamp 53.

In the step S14, if the identification codes are invalid, the procedure returns to the step S12.

It should be emphasized that the above-described embodiments of the preferred embodiments, particularly, any "preferred" embodiments, are merely possible examples of implementations, merely set forth for a clear understanding of the principles of the invention. Many variations and modifications may be made to the above-described preferred embodiment(s) without departing substantially from the spirit and principles of the invention. All such modifications and variations are intended to be included herein within the scope of this disclosure and the above-described preferred embodiment(s) and protected by the following claims.

What is claimed is:

1. A system for controlling a lighting system in real time, the system comprising:

a computer, comprising:

a light data receiving module configured for receiving light control data inputted by a user; and a light data transmitting module configured for transmitting the light control data to a single chip micyoco (SCM) connected to the computer;

the SCM comprising:

a processing module configured for processing the light control data received by the SCM, and generating digital signals that represent brightness and determining an address of a power amplifier according to the light control data; and a transmitting module configured for transmitting the digital signals to a digital-to-analog converter, the digital-to-analog converter connecting to at least one power amplifier;

wherein the digital-to-analog converter is configured for converting the digital signals into analog signals, and transmitting the analog signals to a corresponding power amplifier according to the address; and the at least one power amplifier is configured for amplifying the analog signals, and for controlling the brightness of a lamp connected to the corresponding power amplifier according to the amplified analog signals.

2. The system according to claim 1, wherein the lamp is a rim light lamp, a coaxial light lamp, or a ring light lamp.

3. The system according to claim 1, wherein the transmitting module is further configured for transmitting the address to the digital-to-analog converter.

4. The system according to claim 2, wherein the light control data comprises light control data of the rim light lamp, light control data of the coaxial light lamp, and light control data of the ring light lamp.

5. The system according to claim 1, wherein the computer further comprises an identification code receiving module configured for receiving identification codes inputted by the user.

6. The system according to claim 5, wherein the computer further comprises an identification code transmitting module configured for transmitting the identification codes to the SCM.

7. The system according to claim 6, wherein the SCM further comprises a validation module configured for validating the identification codes by comparing the identification codes received by the SCM with original identification codes prestored in the SCM.

8. A method for real time control of lighting system, comprising the steps of:

providing a computer, a single chip micyoco (SCM) connected to the computer, a digital-to-analog converter connected to the SCM, and at least one power amplifier connected to the digital-to-analog converter, wherein each power amplifier connects with a lamp;

receiving light control data inputted by a user;

transmitting the light control data to the SCM;

processing the light control data received by the SCM, and generating digital signals that represent brightness and determining an address of a power amplifier according to the light control data by the SCM;

transmitting the digital signals to the digital-to-analog converter;

converting the digital signals into analog signals by the digital-to-analog converter, and transmitting the analog signals to a corresponding power amplifier according to the address; and amplifying the analog signals and controlling the brightness of the lamp connected to the corresponding power amplifier according to the amplified analog signals.

9. The method according to claim 8, wherein the lamp is a rim light lamp, a coaxial light lamp or a ring light lamp.

10. The method according to claim 9, wherein the light control data comprises light control data of the rim light lamp, light control data of the coaxial light lamp and light control data of the ring light lamp.

11. The method according to claim 8, further comprising the step of:

transmitting the address to the digital-to-analog converter.

12. The method according to claim 8, further comprising the step of:

receiving identification codes inputted by the user;

transmitting the identification codes to the SCM; and validating the identification codes by comparing the identification codes received by the SCM with original identification codes prestored in the SCM by the SCM.

* * * * *